United States Patent [19]

Torban et al.

[11] Patent Number: 4,648,671

[45] Date of Patent: Mar. 10, 1987

[54] SELF LOCKING COUPLING DEVICE

[75] Inventors: Yefim Torban, Cheshire; Joseph Hary, Danbury, both of Conn.

[73] Assignee: Allied Corporation, Morristown, N.J.

[21] Appl. No.: 868,980

[22] Filed: May 29, 1986

[51] Int. Cl.[4] ..... H01R 13/623

[52] U.S. Cl. ..... 339/89 R; 339/DIG. 2

[58] Field of Search ..... 339/89 R, 89 C, 89 M, 339/DIG. 2; 285/84, 85, 86, 89

[56] References Cited

U.S. PATENT DOCUMENTS

| | | | |
|---|---|---|---|
| 2,728,895 | 12/1955 | Quackenbush et al. | 339/89 |
| 2,784,385 | 3/1957 | Ennis | 339/89 |
| 2,828,978 | 4/1958 | Wurzburger | 285/85 |
| 2,829,358 | 4/1958 | Testori | 339/DIG. 2 |
| 2,890,434 | 6/1959 | Ray et al. | 339/91 |
| 3,069,187 | 12/1962 | Collins et al. | 285/110 |
| 3,517,371 | 6/1970 | Buckley | 339/89 |
| 3,608,933 | 9/1971 | Lee | 285/39 |
| 3,613,047 | 10/1977 | Kron et al. | 339/89 R |
| 3,673,547 | 6/1972 | Ziegler, Jr. | 339/89 C |
| 3,936,124 | 2/1976 | Tuttle et al. | 339/60 M |
| 4,030,798 | 6/1977 | Paoli | 339/89 |
| 4,066,314 | 1/1978 | Williams | 339/89 R |
| 4,135,288 | 1/1979 | Pitschi | 29/443 |
| 4,208,082 | 6/1980 | Davies et al. | 339/DIG. 2 |
| 4,285,564 | 8/1981 | Spinner | 339/89 |
| 4,500,154 | 2/1985 | Collins | 339/89 |
| 4,506,942 | 3/1985 | Flederbach et al. | 339/89 |
| 4,550,966 | 11/1985 | Riley | 339/84 |

FOREIGN PATENT DOCUMENTS

| | | | |
|---|---|---|---|
| 2136500 | 2/1979 | Fed. Rep. of Germany | 339/89 |

OTHER PUBLICATIONS

Ser. No. 325, 175 Werth, an Electrical Connector (filed 11/27/1981, now abandoned).

*Primary Examiner*—John McQuade

*Attorney, Agent, or Firm*—C. D. Lacina

[57] ABSTRACT

A coupling nut and a lock nut each being generally cylindrical with substantially like outside diameter and having an end face thereof provided with a contiguous 360° plurality of teeth, the coupling nut being mounted for rotation on a plug shell, the lock nut being retained for axial sliding movement on a receptacle shell and biased forwardly by a pre-loaded spring, and the teeth being the same and interengaging only upon nearly full-mate of the shells. To retain the lock nut or change the position of the lock nut whereby to adjust the spring pre-load a pin from the receptacle is received in one of a pair of detents in an L-shaped cavity formed in the lock nut.

6 Claims, 7 Drawing Figures

SELF LOCKING COUPLING DEVICE

This invention relates to an electrical connector assembly having a self-locking coupling arrangement.

An electrical connector assembly typically comprises a plug and a threaded receptacle each carrying an electrical contact for mating, the plug being receivable within the receptacle whereby to mate therewith and establish electrical connection between the contacts, a threaded coupling nut rotatably carried on the plug which upon rotation engages the receptacle thread to move the plug and receptacle axially toward or away from one another depending on the direction of rotation, and an arrangement for resisting unwanted uncoupling rotation of the coupling nut once the assembly is mated.

Provision of interengaging teeth formed on axial faces of connector parts to interfere with otherwise unimpeded rotation of a coupling nut is known. In U.S. Pat. No. 4,285,564 "HF Coaxial Plug Connector" issuing Aug. 25, 1981 to Spinner a compound coupling nut is mounted to the plug. Such a coupling arrangement increases the overall diameter of the connector assembly, is complex, and would be costly to fabricate. Provision of a self-locking coupling arrangement which does not increase package diameter or complexity would be desirable.

According to this invention a self-locking coupling arrangement is characterized by a first and second cylindrical shell each having on its forward axial end face a contiguous set of teeth, the first shell being carried by the plug and defining a coupling nut which engages the receptacle to draw the shells axially together whereby the teeth are brought into engagement and the second shell being mounted for axial sliding movement relative to the receptacle and defining a lock nut, and means including a coil spring carried by the receptacle for resisting rearward movement of the lock nut. Depending on their geometry, when the teeth mesh the assembly is either self-locking or rotation resisting. A detent cavity in the lock nut receives a pin extending radially from the receptacle and permits a user to change the axial position of the lock nut relative to the receptacle, such a change serving to increase/decrease the spring pre-load acting to bias the lock nut forwardly or when the shells are self-locked to manually, axially, retract the lock nut whereby to release the meshed teeth from engagement and allow uncoupling rotation of the coupling nut.

An advantage of such an assembly is provision of rotation impeding teeth which do not engage until the assembly is nearly mated thereby reducing wear and a possibility of metal flakes forming. Adjustability of the lock nut and the spring pre-load advantageously allows the user to adapt to severe uncoupling environments such as vibration. One way of carrying out the invention is described below with reference to the drawings in which.

Figures 1, 2, 3, 4A, 4B, 5, 6:
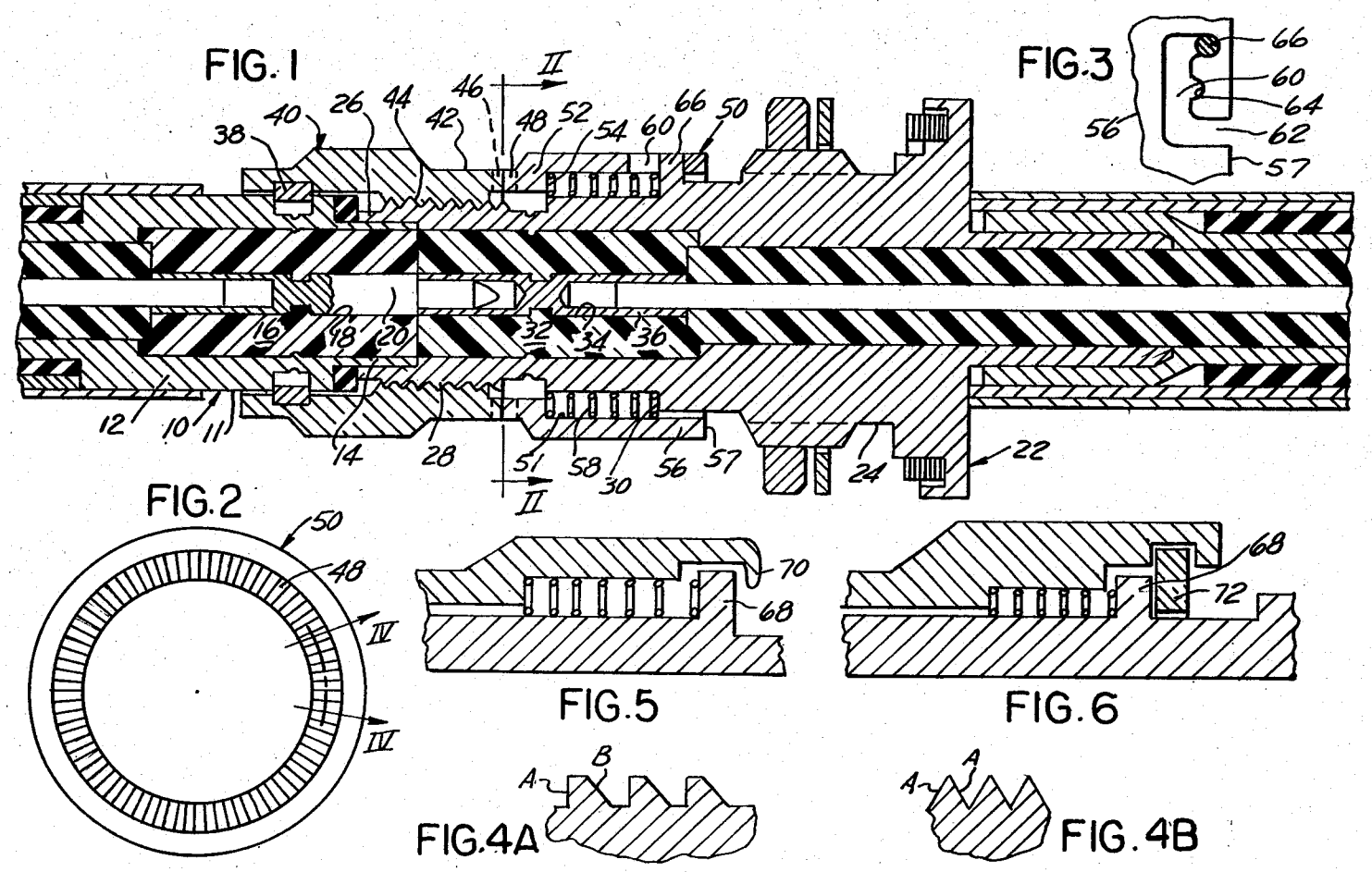
FIG. 1 is a cross-section of a connector assembly.
FIG. 2 is an end view of a lock nut taken along lines II—II of FIG. 1 to show teeth arranged around its end face.
FIG. 3 is a detail of the lock nut mounting in the assembly of FIG. 2.
FIGS. 4A and 4B are taken along lines IV—IV of FIG. 2 and show, respectively, different tooth profiles.
FIG. 5 is a cross-section showing a lock nut mounted to a receptacle.
FIG. 6 is a cross-section showing a lock nut mounted to a receptacle.

Turning now to the drawings, FIG. 1 shows a connector assembly including a plug section 10 mated to a receptacle section 22. The plug section comprises a generally cylindrical shell 12 having a forward end portion 14. A dielectric insert 16 having an axial passage 18 therethrough is mounted in the shell. A pin-type contact 20 is mounted in the passage.

The receptacle section comprises a generally cylindrical shell 24 having a forward end portion 26 provided with external thread 28 and a medial portion provided with a radial shoulder 30, the shoulder defining an abutment surface facing axially forward. A dielectric insert 32 having an axial passage 34 therethrough is mounted in the shell. A socket-type contact 36 is mounted in the passage.

Forward and rearward end portions of the contacts, respectively, mate with one another when the connector sections mate and are terminated to the center conductor of a respective cable to complete a circuit path.

A generally cylindrical coupling nut 40 is rotatably captivated on the plug shell by a retainer ring 38, the nut including on an interior wall thereof internal thread 44 adapted to engage with the external thread on the receptacle shell. Engagement of the thread 28,44 and rotation of the coupling nut 40 in one direction axially draws the plug shell 12 into the forward end portion of the receptacle shell 24 whereby the shells are mated and the contacts 20,36 are electrically interconnected. Rotation of the nut in the other direction uncouples the connector sections.

In accordance with this invention, the coupling nut has a cylindrical forward end portion 42 extending forwardly of the plug forward end face and terminating in an end face provided with a contiguous 360° plurality of forwardly facing teeth 46.

A lock nut 50 is captivated on the receptacle shell for slidable axial movement relative thereto, an annular space being formed between the inner surface 51 of the lock nut and the outer surface of the receptacle shell. The lock nut is generally cylindrical and includes a forward end portion 52 and a rearward end portion 56, the forward end portion 52 terminating in an end face provided with a contiguous 360° plurality of forwardly facing teeth 48 to engage the teeth 46 on the coupling nut 40 and the rearward end portion 56 being mounted to the receptacle shell. The forward end portion 52 includes an interior shoulder 54 which faces axially rearward and defines an abutment surface. The end faces of the lock nut 50 and coupling nut 40 are generally disposed in a plane perpendicular to the axis of rotation.

Mounting a cooperating nut on each connector section allows the outside diameter of each nut to be substantially the same thereby reducing the size of the overall interconnection.

A pair of axial coil springs 58 to resist axial rearward movement of the lock nut are enclosed in the annular space formed between the receptacle shell and the lock nut. Each spring has, respectively, one and the other end thereof abutting the interior shoulder 54 on the lock nut and the forwardly facing radial shoulder 30 on the receptacle shell. Depending on the axial position of the lock nut 50 relative to the receptacle shell, the springs are in compression and provided with a pre-load so that the the resistance of the lock nut to rearward forces as would be applied by the teeth meshing may be either increased or decreased. If desired by a user, a single coil spring could could be disposed in the annular space such that its coils are completely encircling the outer surface of the receptacle shell.

The lock nut 50 is constrained for axial movement relative to the receptacle. The rearward end portion 56 of the lock nut terminates in an end face 57 facing axially rearward and includes an L-shaped detent cavity 60, the foot 62 of the "L" opening onto the rear end face and the cavity including one or more axially extending detents 64. A key pin 66 extending radially from the receptacle shell is received in one of the detents 64 and constrains the shell to axial motion.

FIG. 2 shows the forward end face of the lock nut 50 and the contiguous set of teeth 48 disposed 360° therearound. Although not shown, the set of teeth 46 on the end face of the coupling nut 40 are complementary to the set of teeth 48 (e.g., have the same tooth profile).

FIG. 3 shows the retention arrangement for the lock nut relative to the receptacle wherein the key pin 66 is received in a detent 64. The detents define axial grooves each being of different length and thereby allowing the lock nut position to be changed and thus the pre-load in the coil springs to be changed. For assembly, the springs 58 would be positioned on the receptacle shell 24, and the rearward end portion 56 of the lock nut 50 coaxially inserted over the forward end portion of the receptacle. Further rearward insertion will compress the springs between the shoulders 30,54 and bring the key pin 66 into the opening 62 leading into the detent cavity 60 whereupon a slight angular rotation of the lock nut 50 will bring the pin into register with one of the detents 64. Upon release of the nut, the springs will have a pre-load and drive the lock nut axially forward and seat the pin in its detent.

FIGS. 4A and 4B show contiguous V-shaped teeth which define the end faces 46,48 which mesh with one and the other, respectively, being self-locking and rotation resisting. Each self-locking tooth in FIG. 4A has two engagement surfaces "A,B" with surface "A" and surface "B", respectively, being generally 90° and acutely angled to the plane including its end face.

During coupling rotation, the acutely angled surfaces "A" would serve as cams and drive the lock nut axially rearward to allow rotation but the other surfaces "B" would stop rotation. To unlock the self-locking teeth the user would grasp the lock nut 50 and pull it axially away from the coupling nut 40 whereby the two sets of teeth 46,48 are disengaged and the coupling nut may be rotated to disengage the thread.

In FIG. 4B the teeth have two acutely-angled surfaces "A" with each serving as a cam thereby resisting rotation in both directions so long as the teeth 46,48 are interengaged. Rotation resistance can be changed by increasing the acute angle towards the 90° condition.

FIG. 5 shows a lock nut retention wherein a flange 68 extends radially outward from the receptacle shell, and the lock nut has a rearward end portion 70 thereof deformed radially inward to seat behind the flange, thereby "non-removably" retaining the lock nut and the springs to the receptacle shell.

FIG. 6 shows a lock nut retention wherein a flange 68 extends radially outward from the receptacle shell, the rearward end portion of the lock nut is provided with an annular groove, and a snap ring 72 is received in the groove, thereby "removably" retaining the lock nut and the springs to the receptacle shell.

Having thus described the invention what is claimed is:

1. A self-locking electrical connector assembly comprising a receptacle, a plug, a coupling nut rotatably captivated on the plug for threadable engagement with the receptacle, and locking means for locking the assembly together when the coupling nut has drawn the plug into the receptacle, the locking means being operative only near fully mate and comprising a lock nut slidably mounted on the receptacle and axially constrained to move from a forward first position to a rearward second position, a spring resisting rearward movement of the lock nut and biasing the lock nut into the first position, adjustable retention means for changing the axial position of the lock nut relative to the receptacle and pre-loading the spring, the adjustable retention means comprising an L-shaped detent cavity disposed adjacent to the rearward end face of the lock nut, and a pin extending radially from the receptacle being received in the cavity, the cavity opening on the end face to receive the pin and including a pair of detents each for receiving the pin and constraining the lock nut for axial movement, and a first and second set of interengageable teeth each, respectively, being disposed on one and the other nut and adapted to engage with the other when mated.

2. The connector assembly as recited in claim 1 wherein the forward end face of each said nut includes its respective plurality of teeth, each forward end face being disposed in a plane generally perpendicular to the axis of rotation and each set of teeth forming a contiguous 360° set of like profiled teeth.

3. The connector assembly as recited in claim 1 wherein the forward end portion of said coupling nut and said lock nut are of substantially the same outside diameter and the forward end face of the coupling nut extends axially forward of the forward end face of the plug.

4. The connector assembly as recited in claim 2 wherein each said tooth has two surfaces one of which being acutely-angled to said plane perpendicular to the primary axis of rotation.

5. The connector assembly as recited in claim 2 wherein each said tooth has two surfaces one of which being substantially perpendicular to its end face.

6. A releasable locking means for an electrical connector having a plug shell receivable within a receptacle shell and a coupling nut rotatably mounted on the plug shell for connecting to the receptacle shell whereby to cause the shells to move toward or away from one another depending on the direction of rotation, characterized in that the coupling nut has a forward end portion terminating in an axial end face provided with a contiguous plurality of first teeth, a lock nut is constrained on the receptacle shell for axial slidable movement relative thereto and has a forward end portion terminating in an axial end face provided with a contiguous plurality of second teeth, bias means for biasing the lock nut axially forward, and adjustment means for pre-loading the bias means, the adjustment means comprising said lock nut including an L-shaped detent cavity having a pair of detent grooves each of different axial extension, and a pin extending radially outward from the receptacle shell for receipt into one or the other said groove, the first and second teeth meshing together only near full mate, and the lock nut and the coupling nut having substantially like outside diameters adjacent to their respective end faces that mesh.

* * * * *